United States Patent [19]

Winkler

[11] 4,174,486

[45] Nov. 13, 1979

[54] ADJUSTABLE SHELVING SYSTEM

[76] Inventor: Clifford W. Winkler, P.O. Box 561, Rte. 2, Houghton Lake, Mich. 48629

[21] Appl. No.: 856,666

[22] Filed: Dec. 2, 1977

[51] Int. Cl.[2] ..... A47F 5/00; A47G 29/02

[52] U.S. Cl. ..... 312/138 R; 312/138 A; 211/153; 108/152; 248/246

[58] Field of Search ..... 312/138 R, 138 A, 253, 312/311; 248/246, 250; 211/181, 153; 108/108, 152

[56] References Cited

U.S. PATENT DOCUMENTS

| | | | |
|---|---|---|---|
| 723,677 | 3/1903 | Kade | 248/250 |
| 1,219,158 | 3/1917 | Rose | 108/152 |
| 1,276,677 | 8/1918 | Mittleburg | 248/246 |
| 2,639,817 | 5/1953 | Ehret | 108/152 |
| 2,984,533 | 5/1961 | Sundberg | 312/138 A |
| 3,080,980 | 3/1963 | Gibbons | 108/152 |
| 3,111,916 | 11/1963 | Bjerke | 108/152 |
| 3,225,720 | 12/1965 | Maslow | 211/181 |
| 3,355,134 | 11/1967 | Chesley | 108/108 |
| 3,710,734 | 1/1973 | Bofferding et al. | 248/246 |
| 4,033,540 | 7/1977 | Hamblin | 248/246 |

*Primary Examiner*—Victor N. Sakran
*Attorney, Agent, or Firm*—Krass & Young

[57] ABSTRACT

An adjustable shelving system comprises two or more upright standards each having a forwardly projecting shelf support member pivotably depending therefrom which is infinitely vertically adjustable therealong. When positioned horizontally, the support members lockingly engage with their respective standards. The members secure a shelf by means of brackets which are mechanically affixed to the shelf and spaced to define rearwardly opening cavities which receive the support members. Each shelf comprises a wire grid of a plurality of longitudinally and laterally disposed members. Each bracket has outwardly projecting tabs which encircle two adjacent longitudinal members of the shelf. Each bracket also has a raised central portion and downwardly, inwardly projecting tabs which collectively embrace the shelf support member. The shelf can be expeditiously vertically repositioned by tipping the shelf and associated bracket and support members upwardly to an acute angular relationship with the standards and then vertically repositioning the shelf to its new desired location. To lock the shelf, it is merely rotated back to the substantially horizontal position. The shelf may have a retention lip and/or a storage container integral therewith.

3 Claims, 8 Drawing Figures

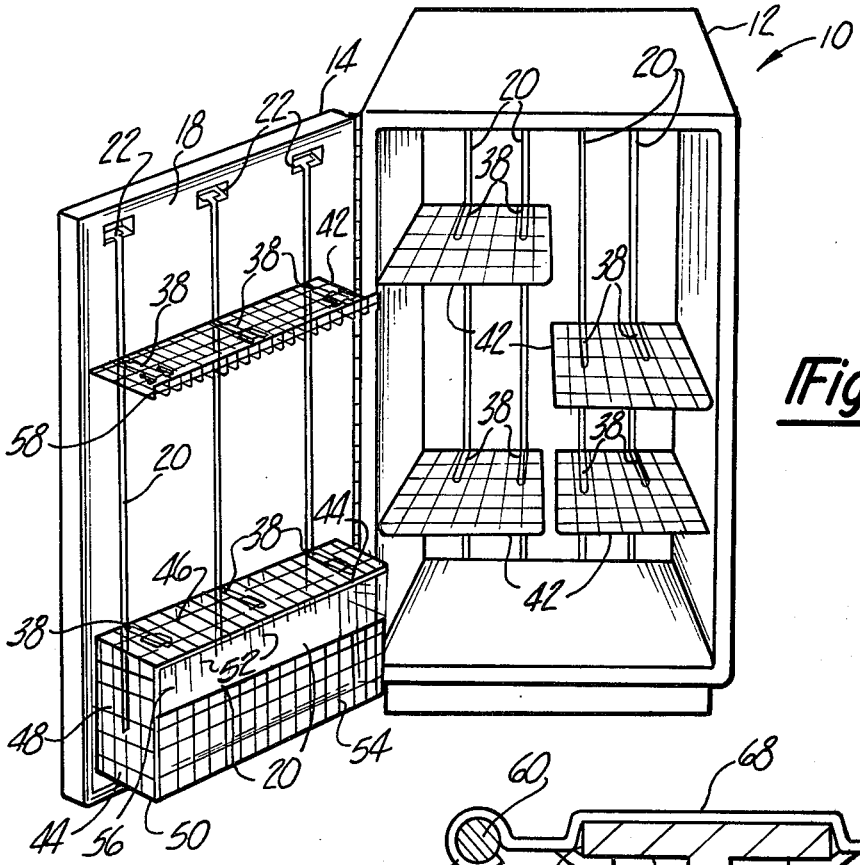
Fig-1
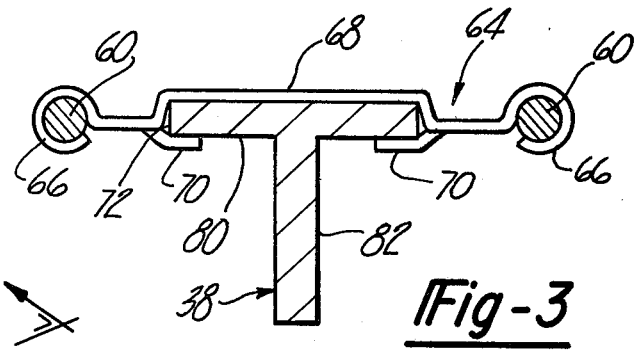
Fig-3
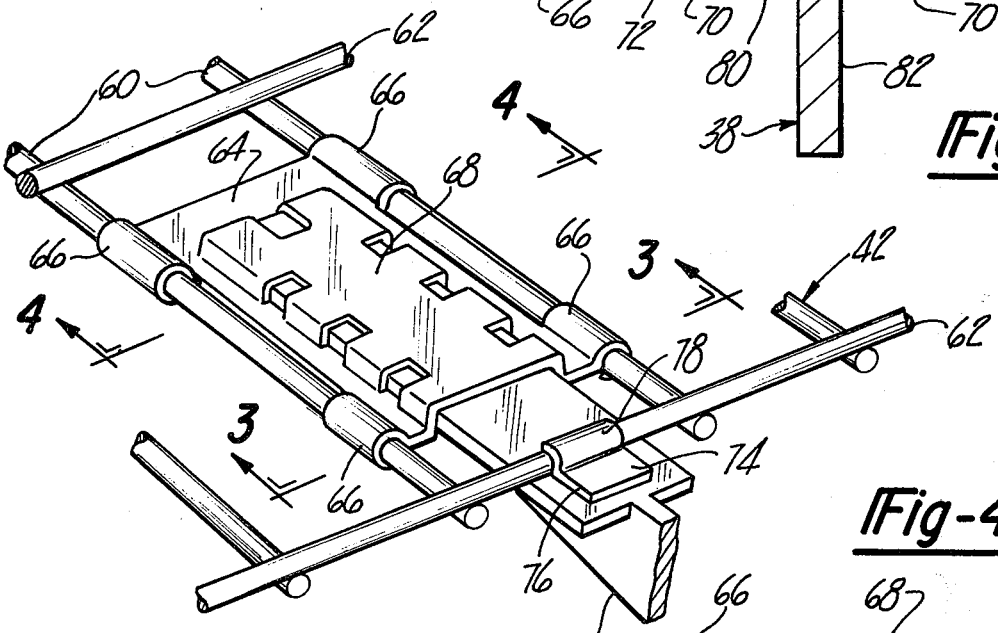
Fig-2
Fig-4
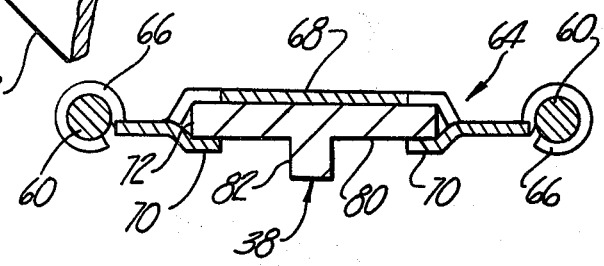

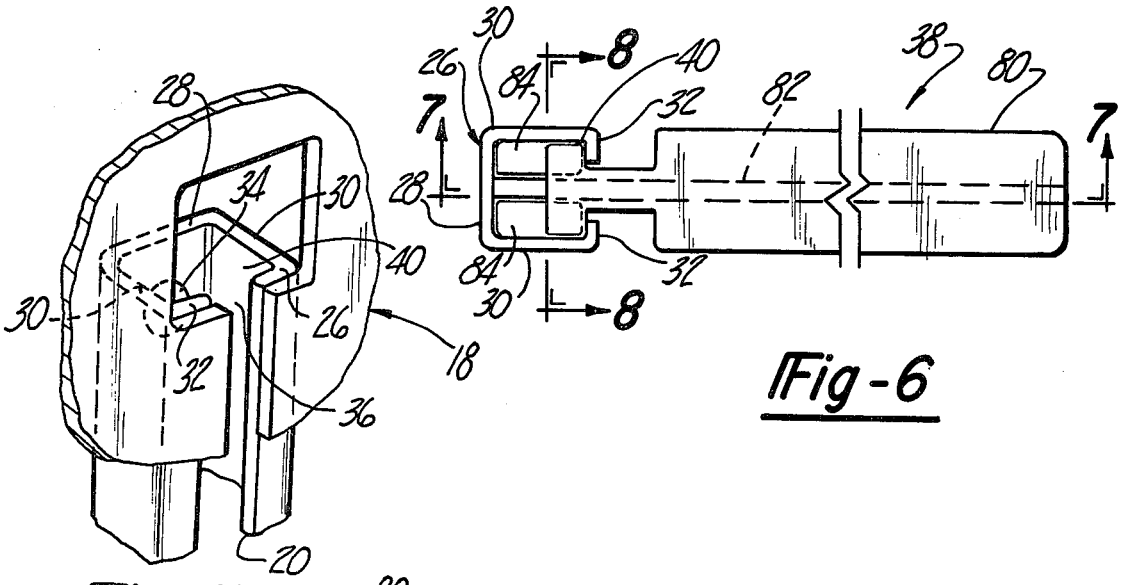
Fig-6
Fig-5
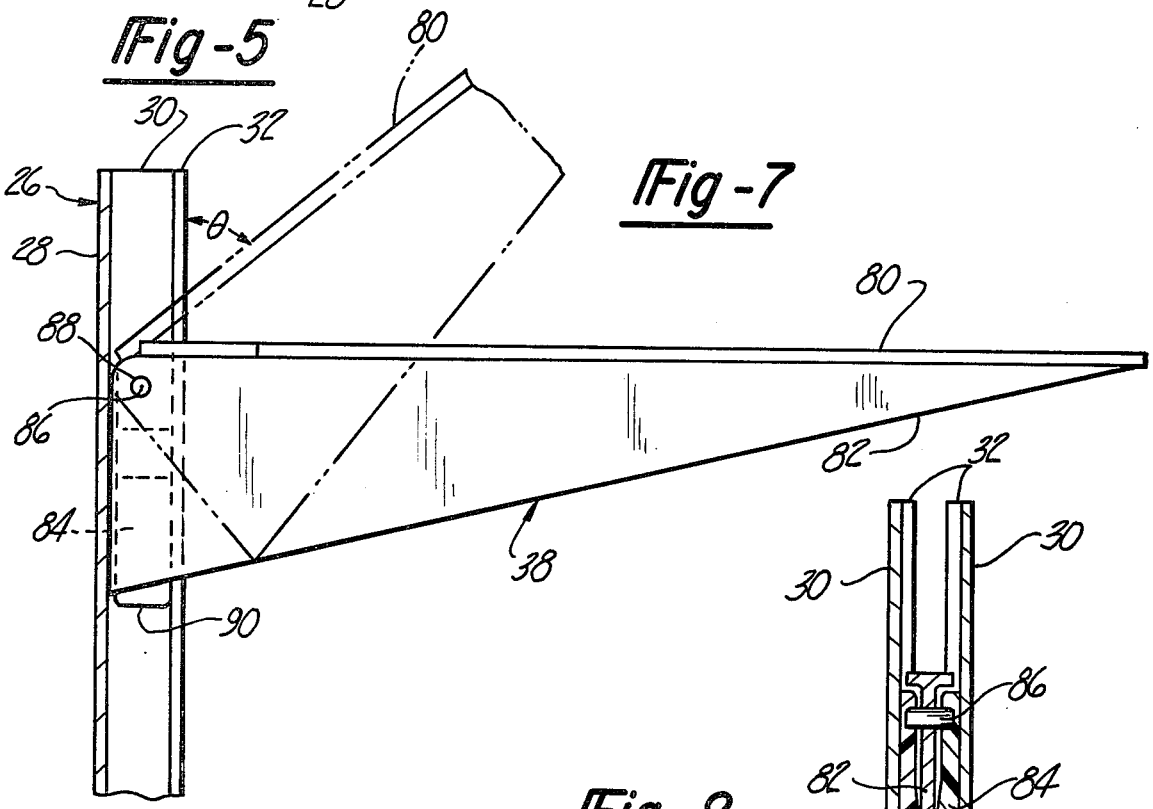
Fig-7
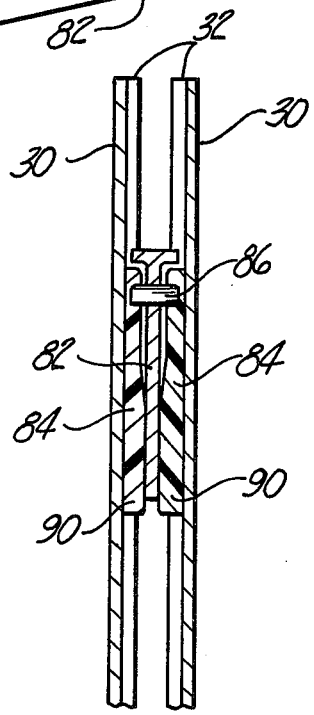
Fig-8

ADJUSTABLE SHELVING SYSTEM

BACKGROUND OF THE INVENTION

1. Field of the Invention

The invention relates to adjustable shelving systems in general and particularly to systems which are incorporated within home appliances, the individual shelves being infinitely vertically repositionable.

2. Prior Art

Adjustable shelving arrangements have long been used in home appliances such as refrigerators, freezers, dishwashers and the like. Typically, these structures employ a pair of vertically upright members, each having at least one row of slots to vertically aligned therealong to accommodate shelf supporting brackets. Such arrangements are disclosed in U.S. Pat. Nos. 3,701,325; 3,355,134 and 3,111,916. The vertical position of a shelf is adjusted by disconnecting the bracket from a given slot and reinserting it into a higher or lower slot within the member. The vertical upright members are secured to the inside liner of the appliance and supplemental tabs or bosses are provided to support the forwardmost edge of the shelf. The shelves and supporting brackets frequently are interconnected by means of clamps and assorted hardware necessitating the use of tools to assemble and/or adjust the shelving within an appliance.

A drawback of most prior art appliance shelving arrangements is that the shelves are vertically adjustable in discrete increments only thereby limiting their effectiveness in optimizing the use of freezer and/or refrigerator space. A related problem is that the shelves are difficult or inconvenient to remove for cleaning and/or readjustment. Additionally the large amount of hardware and bracketry involved makes the prior art units relatively expensive as well as tending to consume large amounts of space within the appliance which otherwise could be applied for storage. Finally, such shelving arrangements have a limited load capacity and cause extensive damage to the appliance liner when they fail.

SUMMARY OF THE INVENTION

An object of the present invention is to provide an adjustable shelving arrangement for appliances such as freezers, refrigerators, dishwashers and the like which is infinitely variably adjustable in vertical position, can be easily removed and replaced, is relatively inexpensive, compact and aesthetically attractive. In general this is accomplished by providing upright standards within an appliance, each having an elongated shelf support member pivotably depending therefrom which can be slidably repositioned vertically along the upright standard and locked at any point therealong by pivoting the member from an acute angle with respect to the standard to a position normal thereto. The elongated member supports a shelf comprising a rigid wire grid of longitudinal and laterally disposed members. Brackets are affixed to the shelf which are disposed mediate two adjacent longitudinal members and are fixedly attached thereto. The bracket has a rearwardly opening channel dimensioned to receive a shelf support member and be retained by same.

To adjust the vertical position of the shelf, it merely need be pivotably displaced upwardly until the shelf support member is free to slide vertically along the standard. At this point the shelf is positioned to the desired height and then pivoted outwardly until it is substantially horizontal or normal to the standard.

In the preferred embodiment of the invention, the standards are imbedded within the structure of an appliance behind the inner liner thereof. Accordingly, only a relatively small vertical slot in the liner is necessary in order to accommodate the shelf support members. By locating a number of these standards throughout the back wall and door of the appliance, any number of shelves, baskets and the like can be mounted and easily and quickly readjusted without the aid of tools or the like. The individual shelves can be removed by sliding them horizontally outwardly of the appliance while disengaging the bracket from the support member. Cavities are provided at the upper end of each liner slot to permit removal of the shelf support member.

Other objectives and advantages of the present invention will be made apparent from the following detailed description of the preferred embodiment of the invention. The invention makes reference to the accompanying drawings.

DESCRIPTION OF THE DRAWINGS

FIG. 1 illustrates in perspective view an upright freezer incorporating the preferred embodiment of the invention.

FIG. 2 illustrates in perspective view the details of a typical shelf, bracket and shelf support member;

FIG. 3 is a cross-sectional view of the shelf, bracket and shelf support member of FIG. 2;

FIG. 4 is another cross-sectional view of the shelf, bracket and shelf support member of FIG. 2;

FIG. 5 is a perspective view of the end of a typical standard and its associated shelf support member assembly receiving cavity;

FIG. 6 illustrates a top plan view of a standard and shelf support member;

FIG. 7 shows a side plan sectional view of the standard and shelf support member of FIG. 6, the member being illustrated in the unlocked position in phantom; and, FIG. 8 shows a front plan sectional view of the standard and shelf support member of FIG. 6 including its friction mechanism.

DETAILED DESCRIPTION

Referring to FIGS. 1 and 5 the preferred embodiment of the invention is illustrated as applied to the interior of an upright freezer 10 comprising a substantially rectangular cabinet 12 and a vertically hinged door 14. Although an upright type freezer is illustrated it is contemplated that the present invention would be equally applied to a chest type freezer, refrigerator, dishwasher, barbecue, oven and the like. The freezer 10 has a one-piece plastic liner 16 within the cabinet 12 and a door liner 18 both of which are constructed of molded plastic material or the like.

A number of vertically oriented slots 20 are provided within the liners 16 and 18 which run the entire vertical extent the inside dimension of the freezer 10 terminating in a shelf support member receiving cavity 22 at the upper end thereof. The function of the cavity 22 will be described in detail hereinbelow. FIG. 5 illustrates the detail of the cavity 22 which is typical for all of the slots 20. The slots 20 open into a vertical closed cavity 24 which nestingly receives an upright standard 26. The standard 26 is constructed of extruded metal or the like having a C-shaped horizontal cross-section comprising a back-portion 28 two laterally opposed side portions 30 and two inwardly turned lips 32. The standard 26 has a uniform cross-section throughout and is adapted for mounting to the freezer door 14 and cabinet 12 structure by means of screws 34 or other suitable fastening means. The lips 32 terminate inwardly defining a channel slot 36 which is of substantially the same dimension and substantially aligned with its associated slot 20.

A plurality of outwardly projecting elongated shelf support members 38 each have an associated friction mechanism the details and operation of which will be described below are received within the channel 40 defined by the standard 26. Consequently, the shelf support members can be slidably repositioned vertically along the entire extent of the standard 26, the member projecting inwardly through the standard slot 36 and slots 20 within the liners 16 and 18. The support member 38 can be lockingly engaged with the standards 26 at any point therealong, the advantages of which will be described hereinbelow.

Shelves 42 and storage baskets 44 are slidably affixed to that portion of the support members 38 which project inwardly within the freezer 10. Any number of variations of shelves 42 and baskets 44 can be employed, those illustrated in FIG. 1 being exemplary only. The shelves 42 and baskets 44 can be vertically adjusted merely by gripping the shelf 42, for example, tilting it upwardly about its rearwardmost edge which is nearest its associated support members 38 can then be vertically slidably repositioned and then relocked by pivoting the shelf 42 downwardly to reassume a substantially horizontally orientation. The storage baskets 44 operate substantially the same way comprising downwardly projecting wire cages having top 46 side 48 bottom 50 rear 52 and front 54 portions combining to define a substantially cubicle basket having a contents receiving opening 56 adjacent the upper end thereof.

Additionally, for the shelves 42 mounted on the door 14 of the freezer 10, upwardly turned lips 58 are provided to prevent the shelf 42 contents from sliding off during opening and closing of the door 14. An additional advantage of this arrangement is that the standards 26 are supported by the internal structure of the freezer 10 and not by the liners 16 and 18 as is typically found in the prior art. This eliminates any strain or load being impressed on parts of the liners 16 and 18 proximate the slots 20. No pegs or permanent supports for the shelves 42 are required thereby conserving freezer space. In application, a freezer 10 can be quickly and efficiently packed by placing contents therein first on the lower shelves and then quickly vertically adjusting the upper shelves downwardly until they nearly overlay the contents directly therebelow.

Although the standards 26 are illustrated being recessed within the liners 16 and 18, it is contemplated that the subject shelving system could be retrofitted onto an existing unit, the standards being mounted directly to the liners 16 and 18. Additionally, it is contemplated that the present invention can be implemented within various appliances such as chest type freezers, refrigerators, stoves, barbecues and the like as well as a shelving system in and of itself for use in a larger, commercial application.

Referring to FIGS. 2, 3 and 4 the connection of a typical shelf 42 with a shelf support member 38 is illustrated. In the preferred emobidment of the invention the shelves comprise wire grids of longitudinally and laterally oriented members, 60 and 62 respectively. It is contemplated, however, that many various designs well-known in the art could be applied to the shelf 42. For example, a portion of the surface of the shelf 42 could be constructed of plate glass or the like. The only portion of the shelf which must be constructed of the above described wire grid is that portion which is immediately adjacent the shelf support member 38.

A shelf support bracket 64 mechanically interconnects the shelf 42 and its associated shelf support member 38. The bracket 64 is constructed of metallic material comprising four outwardly projecting support tabs 66 which encirclingly embrace two adjacent longitudinal members 60 of the shelf 42 and are rigidly affixed thereto such as by welding. The shelf support bracket thus becomes essentially a common part of the shelf 42 and it is contemplated that numerous variations obvious to artisans can be made therefrom including integral incorporation of the bracket 64 within the shelf 42. The central portion of the bracket 64 is a raised surface 68 from which seven lanced tabs 70 depend and project downwardly and inwardly. The tabs 70 and raised portion 68 define a rearwardly opening cavity 72 which matingly receives a shelf support member 38. The outwardly projecting tabs 66, the raised surface 68 and the seven lanced tabs 70 are integral parts of the shelf support bracket 64.

A spring clip 74 comprises a horizontally oriented flat portion 76 which is affixed to the shelf support member 38 and an arcuate portion 78 which in application projects towards the shelf 42 and partially embraces the rearwardmost lateral member 62 of the shelf 42 to prevent longitudinal displacement thereof. The shelf 42 can be removed from the support member 38 by pulling it longitudinally away from the member 38 and releasing the rearwardmost lateral member 62 from the embrace of the spring clip 74. As the member 62 is so released, the arcuate portion 78 of the spring clip 74 deflects upwardly, returning to its normal position after the member 62 has passed. In the preferred embodiment the shelf support member 38 is substantially T-shaped and has a vertical cross-section having a substantially horizontal upper portion 80 the lateralmost sides thereof being embraced by the lanced tabs 70 and raised portion 68 of the bracket 64. The shelf support member 38 also has a substantially vertically oriented portion 82 which is of substantial uniform thickness and tapers upwardly and forwardly throughout the length of the support member 38. The structural advantages of this particular shape are well-known to those skilled in the art.

Referring to FIGS. 6, 7 and 8 the preferred embodiment of the standard 26 shelf support member 38 and an internal friction mechanism is illustrated. Numerous infinitely adjustable shelf and bracket assemblies are currently available. The applicant, however, chose the unit manufactured by Archibald Kenrick and Sons, Ltd. of Birmingham, England, because of its aesthetic attractiveness, compactness and extremely high loading capability. A complete technical description and discussion of the advantages of this unit in other applications is found in an application for a United States Patent Ser. No. 569,994 filed Apr. 21, 1975.

The friction mechanism is comprised of two shoes 84 of resilient material which are elongated vertically and dimensioned to be slidingly disposed within the channel 40 defined by the standard 26 adjacent and abutting the laterally disposed sides 30 thereof. Proximate the uppermost end of each shoe 84 is an inwardly opening cavity which receives a pivot pin 86. The rearwardly uppermost part of the vertical part 82 of the support member 38 has an aperture 88 which when assembled is in registry with the cavities within the shoes 84. The support member 38 is thereby pivotably supported by the pin 86 and the shoes 84, the entire assembly being vertically slidably disposable within the standard 26 when support member 38 is tilted upwardly, as illustrated in Phanton, to define an actue angle $\theta$ with respect to the standard 26. The lowermost portion of the shoes 84 have a laterally thickened section to provide a slight interference fit with the lower rearwardmost vertical portion 82 of the support member 38 when the member 38 is positioned substantially perpendicular to the standard 26. In this position, the shoes 84 are pressed outwardly firmly against the insidemost surface of the side portions 30 of the standard 26 thereby preventing displacement of the support member 38 with respect to the standard 26. The horizontal part 80 of the shelf support member 38 terminates approximately one inch forwardly of the pivot pin 86 to provide clearance for the liners 16 and 18.

It is to be understood that the invention has been described with reference to a specific embodiment which provides the features and advantages as previously described, and that such specific embodiment is susceptible of modification as will be apparent to those skilled in the art. Accordingly, the foregoing description is not to be construed in a limited sense.

The embodiments of the invention in which an exclusive property or privilege is claimed are defined as follows:

1. An adjustable shelving support system for appliances and the like comprising:

at least a pair of parallel spaced standards, each having a thin-walled rigid body exhibiting a continuous slot opening in one side thereof;

at least one rigid shelf support arm operatively engaged with each of said pair of standards through said opening, each said support arm including selectively operatable lock means within the associated standard whereby each arm may be fixed in relation to the associated standard when at right angles thereto but released for sliding relationship when rotated away from the right angular relationship;

each shelf support arm having a T-shaped cross section in which the top thereof is adapted to receive and support thereon a flat structural element such as a standard wood shelf;

a shelf constructed of rigid wire elements and of such width as to extend between said standards;

a pair of adaptor brackets substantially permanently fixed to the elements of said shelf in spaced parallel relationship according to the space between said standards, each of said brackets comprising a body having an interior space opening to an end thereof for receiving the T-shaped arm therein through said end opening whereby the shelf may be positively secured to the arms by sliding said arms into said brackets to form a unit consisting of the arms, brackets and shelf, said unit being positionally adjustable relative to the standard as aforesaid and said shelf being removable from said arms by sliding said arms out of said interior spaces;

each bracket being at least substantially wholly within the boundaries of said shelf when secured thereto in operative relationship but with the end opening and the interior space located adjacent but out of the plane of said shelf so as to permit said arm to enter said opening for operative engagement therewith.

2. Apparatus as defined in claim 1 wherein the appliance comprises a housing, said standards being attached to said housing, and a liner member also attached to said housing so as to conceal said standards but having spaced parallel slot openings formed therein and in registry with the slot openings of said standards to permit access between said arms and said standards.

3. Apparatus as defined in claim 1 wherein the shelf further comprises a wire basket depending therefrom.

* * * * *